United States Patent [19]

Batty et al.

[11] Patent Number: 4,780,094

[45] Date of Patent: Oct. 25, 1988

[54] EXTENSION CORD OF UNDERCARPET FLAT CABLE

[75] Inventors: William Batty, Winston-Salem; Albert D. Willette, Pfafftown, both of N.C.

[73] Assignee: AMP Incorporated, Harrisburg, Pa.

[21] Appl. No.: 583,282

[22] Filed: Feb. 27, 1984

Related U.S. Application Data

[63] Continuation of Ser. No. 339,559, Jan. 15, 1982.

[51] Int. Cl.[4] ..... H01R 23/66

[52] U.S. Cl. ..... 439/492; 439/502; 439/925

[58] Field of Search ..... 339/9, 28, 29, 17 F, 339/176 MF; 439/32, 33, 502, 77, 447, 492, 495, 499, 925

[56] References Cited

U.S. PATENT DOCUMENTS

| | | | |
|---|---|---|---|
| 3,187,290 | 6/1965 | Winders | 339/28 |
| 3,524,921 | 8/1970 | Wolf | 174/70 |
| 3,573,704 | 4/1971 | Tarver | 339/176 M F |
| 4,281,211 | 7/1981 | Tatum et al. | 174/36 |
| 4,287,385 | 9/1981 | Dombrowsky | 174/36 |

FOREIGN PATENT DOCUMENTS

| | | |
|---|---|---|
| 623765 | 1/1936 | Fed. Rep. of Germany . |
| 1034732 | 7/1958 | Fed. Rep. of Germany . |
| 2457576 | 12/1980 | France . |

*Primary Examiner*—Gil Weidenfeld
*Assistant Examiner*—Gary F. Paumen
*Attorney, Agent, or Firm*—Robert W. Pitts; F. Brice Faller; Robert W. J. Usher

[57] ABSTRACT

An extension cord of flat cable, particularly for undercarpet use, comprising a strip of insulated conductors located in a stiffly flexible sleeve-form shield strip mounted at opposite ends in rigid outlet supporting housings with the conductors terminated to leads of the outlets. At one end of the cable, both the shield strip and the conductor strip are fixed to the housing preventing relative longitudinal movement, while, at the other end, only one of the strips is fixed to the housing, the other strip being free to move relatively longitudinally during a change in the extension cord from reeled to flat condition, Thereby avoiding straining the terminations or buckling the cable. In one example, the shield strip is fixed to the housing and the individual conductors of the conductor strip are connected to leads of the associated outlet by flexible metal bands bowed perpendicularly to the plane of the strip.

8 Claims, 3 Drawing Sheets

EXTENSION CORD OF UNDERCARPET FLAT CABLE

This application is a continuation of application Ser. No. 339,559, filed 1/15/82.

The invention relates to an extension cord of flat cable and particularly to undercarpet flat cable.

A known flat cable, particularly for undercarpet use, comprises a strip of commonly insulated flat conductors in a parallel planar array located under a stiffly flexible shield strip. The conductors are terminated with outlets by mounting the cable ends in rigid insulating outlet supporting housings with the strips in fixed longitudinal relation.

It is often desirable to store predetermined lengths of flat cable in reeled condition for use as extension cords. However, in the known terminated cable the shield strip and the conductor strip are mounted in the outlet supporting housings in fixed longitudinal relation with the consequential disadvantage that, if the cable were so terminated when in flat condition, subsequent reeling would cause relative longitudinal movement between the shield strip and the conductor strip arising from their different wound radii, resulting in strain or destruction of the termination. Alternatively, if the cable were so terminated when in reeled condition, the relative longitudinal movement between the shield strip and the conductor strip would also arise on subsequently unreeling the cable to flat condition, as the strips would be of different lengths, again resulting in strain or destruction of the termination or unacceptable buckling of the cable.

It is an object of the invention to provide an extension cord of flat cable that can both be stored in reeled condition and will lie flat when in unreeled condition without loss of electrical performance.

A further object of the invention is to provide an extension cord of flat cable in which the conductor strip and terminations remain protected both in reeled and unreeled conditions of the cable.

According to the invention, there is provided an extension cord of flat cable comprising, a strip of insulated conductors located for relative longitudinal sliding movement in a stiffly flexible sleeve-form shield strip or sleeve, the cable being mounted at opposite ends in rigid, insulating, outlet supporting housings with the conductors terminated with the outlets in the housings, one of the strips being fixed at one end in one of the outlet supporting housings and the other strip being mounted at that end for longitudinal movement relative to the one strip and the housing.

As a result of the accommodation of relative longitudinal movement between the sleeve and the conductor strip, the extension cord according to the invention can both be stored in reeled condition and be unreeled to flat condition without buckling of the cable or strain of the termination.

In an example of the invention, the sleeve is fixed in the one housing and the conductors are terminated at that end to the supported outlet by flexible metal bands bowed perpendicularly to the plane of the conductor strip to accommodate relative longitudinal movement of the conductor strip and the one housing.

In an alternative example of the invention, the conductor strip is fixed in the one housing and the sleeve is mounted in the one housing as a longitudinal sliding fit relative to the conductor strip and the one housing.

In a preferred construction, the sleeve comprises metal and plastics strips bonded together along adjacent longitudinal edges to extend above and below the conductor strip, respectively, a further metal shield strip being located in the sleeve between the plastics strip and the conductor strip. Both the conductor strip and the sleeve are fixed at their other ends in the other housing with conductors terminated to leads of a plug outlet, the one housing receiving a socket outlet facing away from the plane of the cable.

Examples of extension cords of undercarpet flat cable according to the invention will now be described with reference to the accompanying drawings in which.

Figure 1:
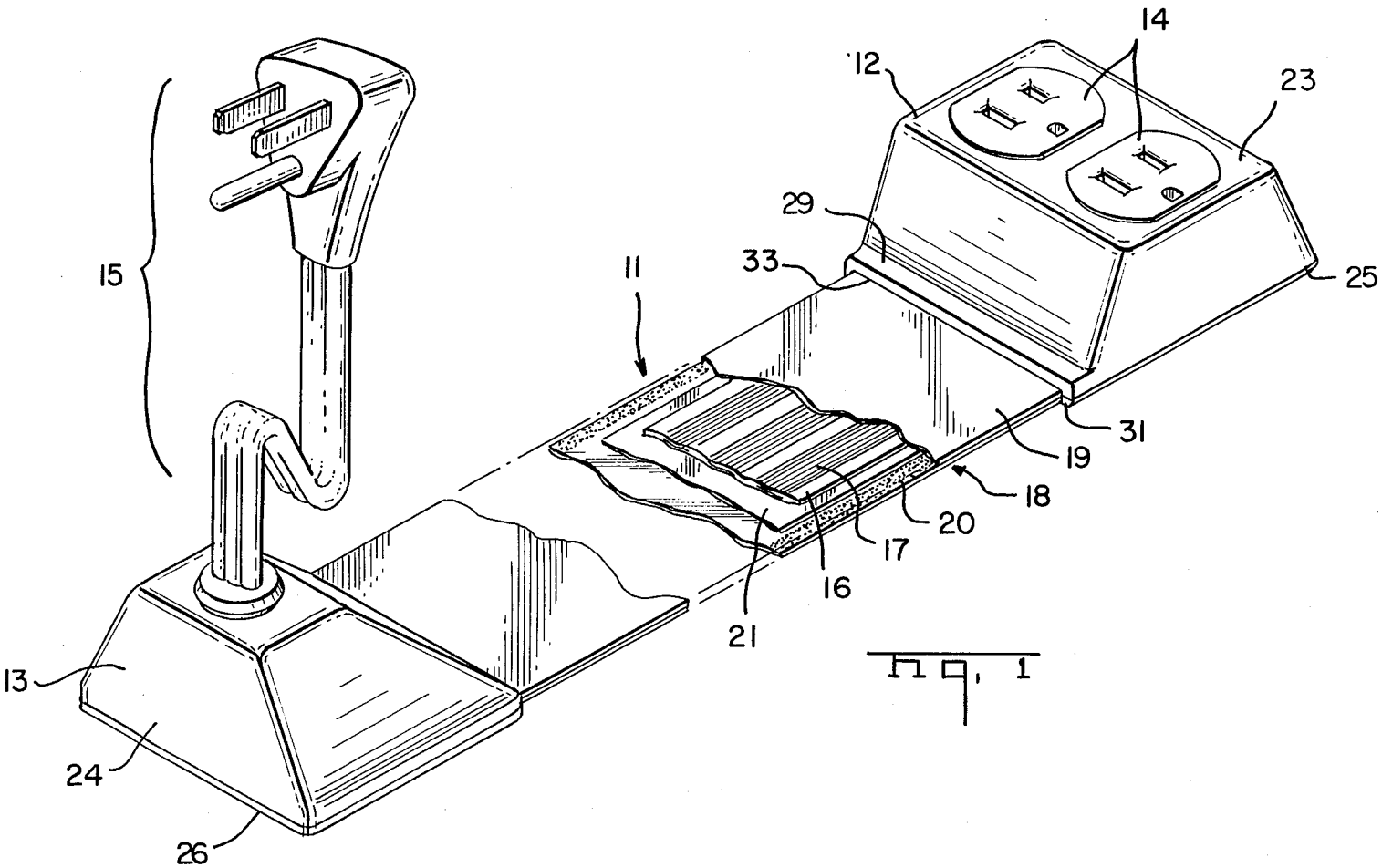
FIG. 1 is a perspective view of a first example of extension cord according to the invention with part of the undercarpet flat cable cut away.
Figure 2:
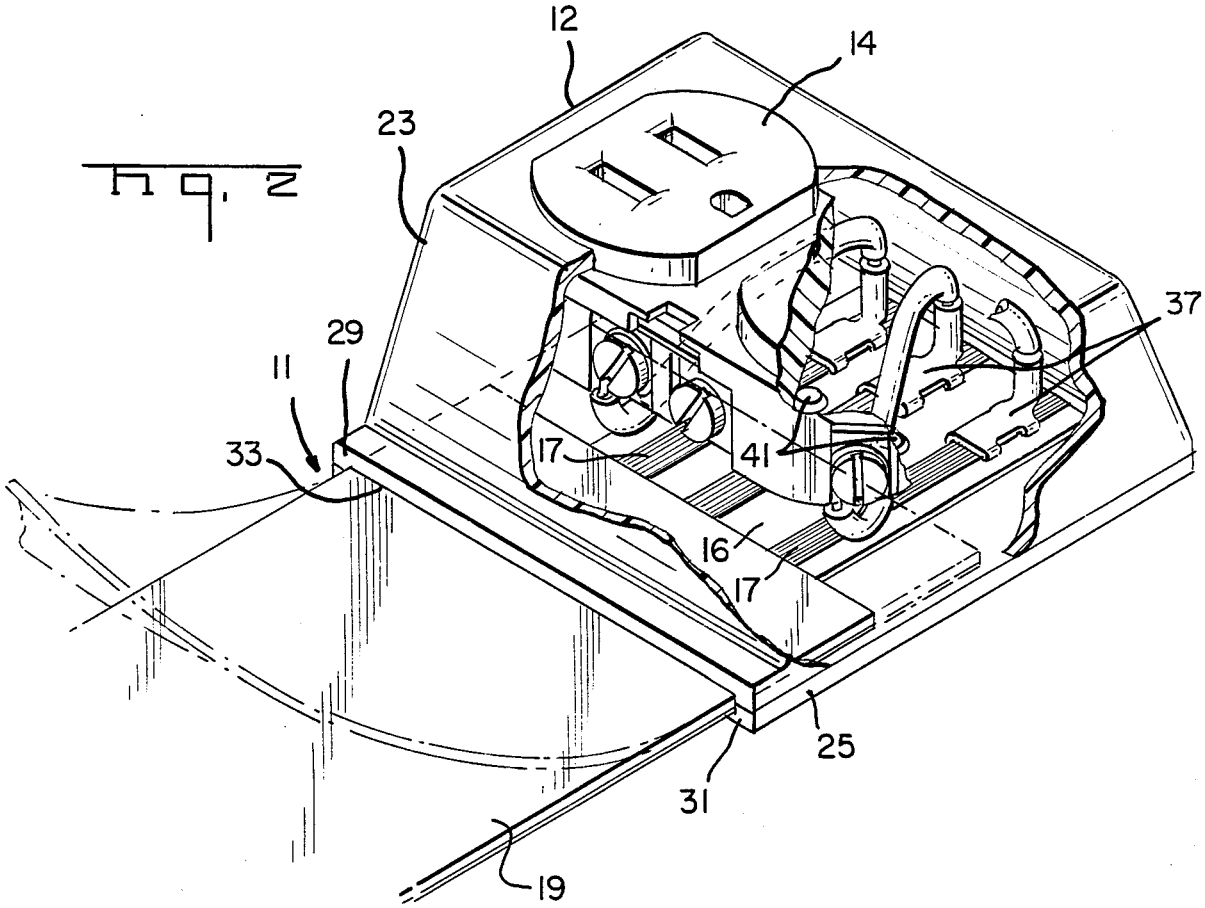
FIG. 2 is a fragmentary perspective view of one end of the first example of extension cord with part of one outlet supporting housing cut away.
Figure 3:
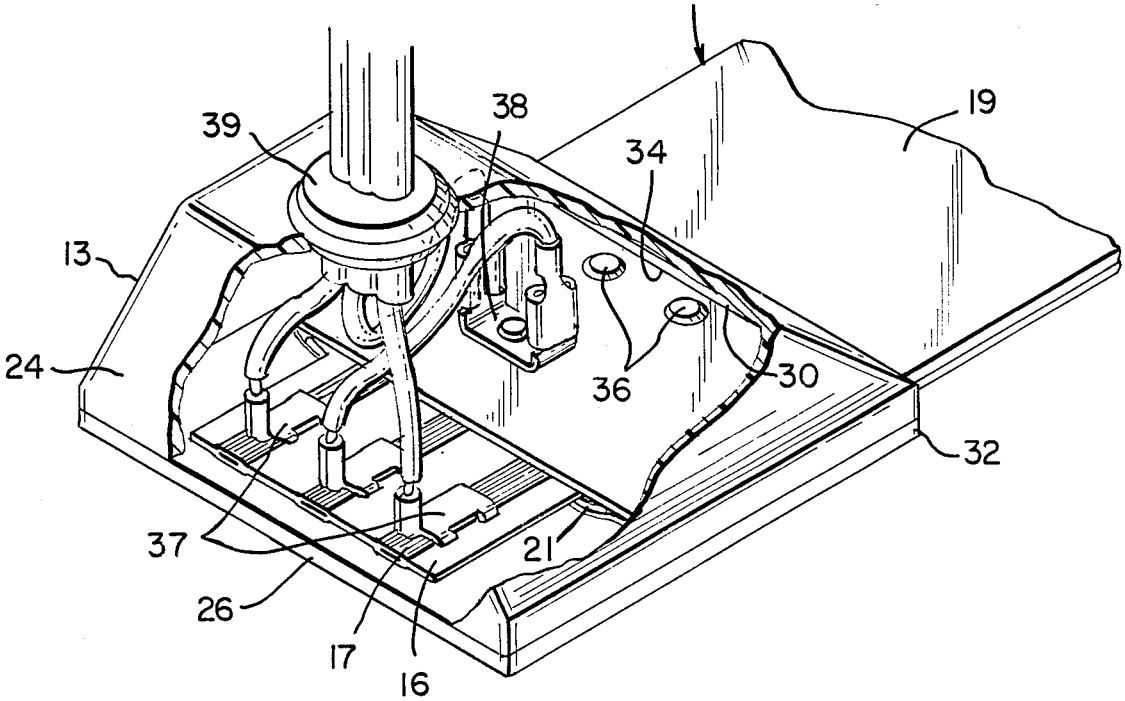
FIG. 3 is a fragmentary perspective view of the other end of the extension cord with part of the other outlet supporting housing cut away.

As shown particularly in FIGS. 1 to 3, the first example of extension cord comprises a predetermined length of undercarpet flat cable 11 mounted at opposite ends in rigid insulating housings 12 and 13, respectively, supporting conventional socket and plug outlets 14 and 15, respectively.

The undercarpet flat cable 11 comprises a strip 16 of commonly insulated flat conductors 17 in a parallel planar array located in a stiffly flexible sleeve-form shield strip 18 comprising metal and plastics strips 19 and 20, respectively, bonded together along adjacent longitudinal edges to extend above and below the conductor strip 16, respectively. A further metal shield strip 21 is located in the sleeve 18 between the conductor strip 16 and the plastics strip 20. It should be noted that, the strips 17, 21 and the sleeve 18 are free to move longitudinally relative to each other prior to termination of the cable.

The outlet supporting housings 12 and 13 are of generally similar construction including covers 23 and 24, respectively, adhered or welded to planar base portions 25 and 26, respectively, so that rebated lip portions 29 and 30 on the covers cooperate with rebated lip portions 31 and 32 on the respective bases to define cable receiving mouths 33 and 34.

As shown more particularly in FIG. 3, one end of the undercarpet flat cable 11 is mounted in the housing 13 by rivets or other fasteners 36 such as projections with heat deformed heads integral with the base portion 26 and which pass through both shield strips 19 and 21 and the insulation of the conductor strip 16 at locations between the conductors 17, fixing the cable strips 16, 19, 21 relative to each other and to the housing base 26. The individual conductors 17 are crimped to respective live and neutral leads of the plug outlet 15 by conventional terminals 37 having insulation-piercing arms which are curled back under the conductor strip into electrical engagement with the conductors. A tab terminal 38 held by a metal rivet passing through top and bottom shield strips 19, 21 is connected by leads to the ground conductor of the cable 11 and socket outlet 15. A bush 39 secures the leads of the plug outlet 15 extending through an aperture in the top of the cover 24.

As shown more particularly in FIG. 2, the other end of the undercarpet flat cable 11 is mounted in the duplex socket supporting housing 12 by rivets 41 or other fasteners which pass through insulation of the exposed conductor strip 16 between the individual conductors 17 thereby fixing the strip 16 to the housing base 25, whilst the sleeve 18 is received as a longitudinal sliding fit in the mouth 33. The individual conductors 17 are also terminated by crimping to conventional terminals connected to leads extending to terminals of the conventional duplex socket outlet 14.

Movement of the cable from the flat condition shown to a wound or reeled condition, indicated by broken lines, will cause the sleeve 18 to slide longitudinally further into the housing to the position shown in broken lines. As the conductor strip 16 is fixed, no stress is imposed on the terminations whilst such sliding movement will permit the cable to lie flat when unwound or unreeled. Longitudinal movement of the shield strip 21 will also be accommodated.

Figure 4:
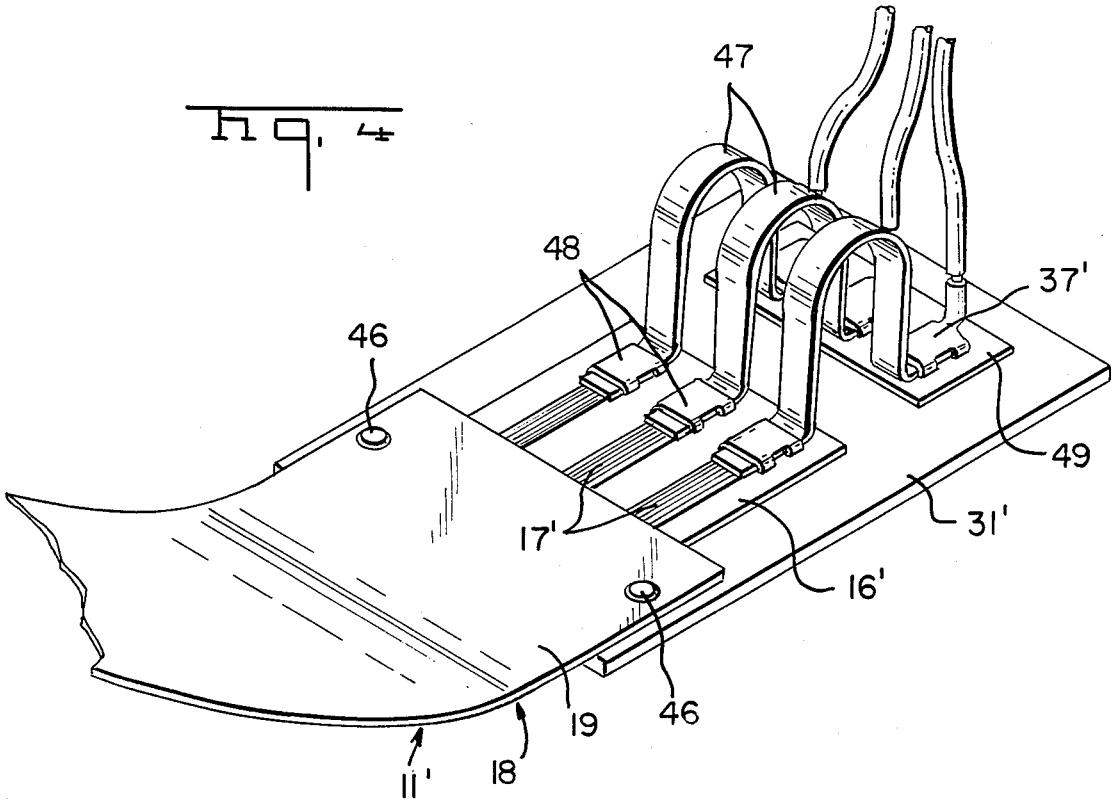
FIGS. 4 and 5 are fragmentary perspective views of one end of a second example of extension cord with a cover of an outlet supporting housing omitted for clarity, showing the relative longitudinal positions of the shield and conductor strips in reeled and flat conditions of the cable, respectively.
Figure 5:
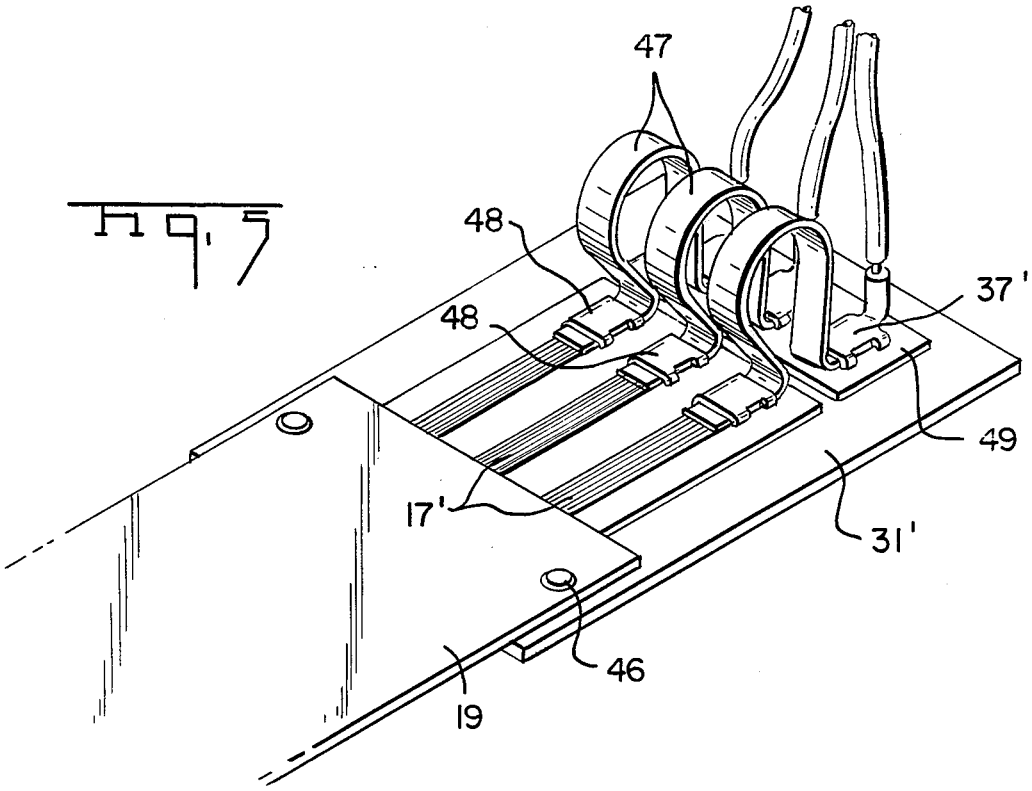

In a second example of the invention, shown particularly in FIGS. 4 and 5, the cable 11 is terminated at one end as shown in FIG. 3 and the sleeve-form shield strip 18 is fixed at the other end to the base 31 by rivets 46 or other fasteners. Flexible metal bands 47 which bow perpendicularly to the plane of the conductor strip 16 are clamped at one of their ends to respective flat conductors 17 by conventional terminals 48 which embrace the strip ends and are crimped around the conductors in a similar fashion to terminal 37, the other ends of the bands being crimped to respective socket outlet leads by conventional terminals 37 also crimped to an insulating terminations strip 49.

Movement of the cable from the wound or reeled condition of FIG. 4 to the flat condition of FIG. 5 will cause the conductor strip 16 to slide longitudinally into the housing from the position shown in FIG. 4 to the position shown in FIG. 5, such movement being accommodated by increased bowing of the bands 47 without undue strain being imposed on the terminations. Unbowing of the bands 47 will also permit the cable to be lie flat when unwound or unreeled.

It should be noted that any tendency for relative movement between the metal shield strip 19 and the plastics strip 20 when changing the cable between wound and unwound conditions will be accommodated by longitudinal flexure of the plastics strip without causing buckling of the cable.

What is claimed is:

1. An extension cord of flat cable comprising a strip of insulated conductors located in a stiffly flexible sleeve-form shield strip, the cable being mounted at opposite ends in rigid insulating outlet supporting housings with the conductors terminated with the outlets of the housings, the shield strip being fixed at one end in one of the outlet supporting housings and the conductors being terminated at that end to the supported outlet by flexible metal bands bowed perpendicularly to the plane of the conductor strip to accommodate longitudinal movement of the conductor strip relative to the shield strip and the one housing.

2. An extension cord according to claim 1 in which the sleeve-form shield strip comprises metal and plastic strips bonded together along adjacent longitudinal edges to overlie the entire width of and underlie the conductor strip, a further metal shield strip being located in the sleeve between the plastic strip and the conductor strip.

3. An extension cord according to claim 1 in which both the shield and conductor strips are fixed at their other ends in the other housing with conductors terminated to leads of a plug outlet, the one housing receiving a socket outlet facing away from the plane of the cable.

4. An end terminated reelable extension cord assembly of flat cable comprises insulative outer support housings and a strip of commonly insulated flat conductors in a parallel planar array located for relative longitudinal sliding movement in a stiffly flexible sleeve comprising a relatively stiff upper strip overlying the conductor strip and a relatively flexible lower strip underlying the conductor strip, the sleeve strips being bonded together along their edges, the conductor strip and sleeve both being mounted at opposite ends in the insulative outlet support housings, one housing having a mouth snugly receiving the sleeve as a longitudinal sliding fit, the conductor strip being fixed in both housings against longitudinal movement relative thereto during movement of the cord between reeled and flat conditions.

5. An extension cord as in claim 4, wherein the sleeve is fixed in the other housing against longitudinal movement relative thereto.

6. An extension cord as in claim 4 wherein a metal shield strip is located in the sleeve between the cable and one of the strips of the sleeve.

7. An extension cord as in claim 6 wherein the metal shield strip is fixed in the other housing against longitudinal movement relative thereto.

8. An extension cord according to claim 4 wherein the upper strip of the sleeve is metal and the lower strip of the sleeve is plastic.

* * * * *